United States Patent [19]

Smith

[11] Patent Number: 4,590,716

[45] Date of Patent: May 27, 1986

[54] GUTTER SYSTEM

[76] Inventor: Clark Smith, 1004 Wedgewood La., Durham, N.C. 27713

[21] Appl. No.: 546,747

[22] Filed: Oct. 28, 1983

[51] Int. Cl.[4] ..... E04D 13/06

[52] U.S. Cl. ..... 52/12; 52/11

[58] Field of Search ..... 52/11, 12, 13, 14, 15, 52/16; 210/154, 162, 473, 474

[56] References Cited

U.S. PATENT DOCUMENTS

| | | | |
|---|---|---|---|
| 84,442 | 11/1868 | Smith . | |
| 456,646 | 7/1891 | Clark . | |
| 493,697 | 3/1893 | Fisk . | |
| 520,993 | 6/1894 | Keller . | |
| 546,042 | 9/1895 | Van Horn . | |
| 603,611 | 5/1898 | Nye . | |
| 749,338 | 1/1904 | Taylor . | |
| 929,684 | 8/1909 | Mills et al. | 52/11 |
| 939,838 | 11/1909 | Hensler | 52/12 X |
| 946,919 | 1/1910 | Koch . | |
| 956,372 | 4/1910 | Kreutzberg . | |
| 1,498,351 | 6/1924 | Clement | 52/15 |
| 2,624,299 | 1/1953 | Beegle | 52/16 |
| 2,669,950 | 2/1954 | Bartholomew . | |
| 2,873,700 | 2/1959 | Heier . | |
| 3,053,393 | 9/1962 | McLean . | |
| 3,295,264 | 1/1967 | Olson . | |
| 3,864,267 | 2/1975 | Nelems | 52/12 X |
| 3,909,905 | 10/1975 | Giordano | 52/12 X |
| 4,028,895 | 6/1977 | Franzmeier . | |
| 4,199,121 | 4/1980 | Le Febvre | 52/12 X |
| 4,254,594 | 3/1981 | Hammond et al. . | |
| 4,435,925 | 3/1984 | Jeffereys | 52/12 |

FOREIGN PATENT DOCUMENTS

| | | | |
|---|---|---|---|
| 18027 | 2/1978 | Japan | 52/11 |
| 122138 | 10/1978 | Japan | 52/11 |
| 8100873 | 4/1981 | PCT Int'l Appl. | 52/11 |
| 318698 | 12/1969 | Sweden | 52/12 |

*Primary Examiner*—John E. Murtagh
*Assistant Examiner*—Richard E. Chilcot, Jr.
*Attorney, Agent, or Firm*—Leonard Bloom

[57] ABSTRACT

A gutter system to exclude contaminants and encourage the migration of water only therewithin including a conduit having a bottom wall, side walls and a top wall, the top wall being provided with a longitudinal slit along its length adapted to receive therewithin a plurality of comb-like teeth depending from the roof, the comb-like teeth disposed in substantially a vertical plane and its associated comb structure optionally having a textured surface for attracting water within the slit by capillary attraction which water is thereafter disposed in the conduit and removed from the premises.

19 Claims, 6 Drawing Figures

GUTTER SYSTEM

BACKGROUND OF THE INVENTION

This invention relates generally to gutters set below and along the eaves of a house or other premises to catch and carry off rain water.

The quest for low and non-maintenance rain gutters has been an ongoing odyssey since the advent of rain diversion technology, the solution for which has eluded technicians even to modern time. Criteria of a good rainwater diversion system include the ability to function in the intended manner and for prolonged periods of use without becoming obstructed by the migration of deciduous matter that perennially besets the maintainers of the associated premises.

The known prior art constitutes a litany of attempts at resolving a long standing yet heretofore unsatisfied need to solve the problem of debris contamination of an eaves gutter system, the list below defining the state of the art of which applicant is aware insofar as the citations appear germane to the process at hand U.S. Pat. Nos.:

84,442 Smith; 749,338 Taylor;
456,646 Clark; 946,919 Koch;
493,676 Fisk; 956,372 Kreutzberg;
520,993 Keller; 2,669,950 Bartholomew; 546,042 VanHorn; 2,873,700 Heier;
603,611 Nye; 3,053,393 McLean;
749,338 Taylor; 3,295,264 Olson;
4,028,895 Franzmeier; 4,254,594 Hammond et al.

The patent to VanHorn is of interest since he teaches the use of an eaves trough or a gutter shield which requires that the outer edge bl of the shield approach closely to the outer wall of the trough or gutter but permits the flow of water between it and the shield into the body of the gutter. Thus, while a major portion of the gutter trough has been occluded by the overlying base portion of the shield, a nesting portion between the end of the base and the gutter B exists which can serve as a nesting spot for debris or a purchase area for ice which forms on the roof and slides off the roof, forcing the gutter to become dissociated from the building due to the pressures exerted by the ice thereon. In addition, debris associated at the purchase area bl can still allow contaminates to enter within the gutter trough, which thereafter becomes exceeding difficult to remove.

The patent to Heier teaches the use of a trough for eaves that is totally shielded, and requires the water to reverse direction down a surface 19 to a leg 21 which to a certain extent defies gravity and thereafter enters into the trough upon conditioning a gate 45. While certainly it is extremely difficult for debris to enter into the trough system, a somewhat similar difficulty, though to a lesser extent, can be perceived for the migration of water therein. Any similarity therefore to the instant application and to Heier appears to be merely coincidental in nature.

Kreutzberg teaches the use of a self cleaning eaves trough which includes a foraminous trough communicating with an inclined water receiver so that "filtering" is evidenced prior to entrance into area 3. It is likely that the foraminous filter 1 may become clogged during use.

The remaining citations are of general interest and appear to diverge even further from that which is claimed as the invention in the instant application.

By way of contrast, the instant application is distinguished over the known prior art in that a gutter system has been provided which firstly, reliably removes accumulated water, secondly, precludes the entrance of debris into the gutter system, thirdly, is devoid of purchase areas which not only allow debris accumulation but also provide a point at which ice sliding down a roof can dissociate the gutter from its support on the premises, fourthly requires substantially no maintenance, and fifthly provides improved dissemination of accumulated liquid such as rain water or melting ice water to remote locations. More particularly, an instrumentality has been provided which includes a substantially closed conduit having elongate configuration provided with a narrow slit along its topmost surface, the conduit removably received in a mounting clip instrumentality, a comb-like structure adapted to be placed within the longitudinal slit so that by capillary attraction, water enters into the conduit for transport away from the premises. To assist in the flow rate within the conduit itself, an inclined bottom wall is provided which tends to increase the flow rate so that, should particulate matter enter within the system, the flow rate flushes same away. The comb-like member can be attached to the leading edge of existing shingles or other roofing substance, or can be integrally formed with the leading edge of the roof.

SUMMARY AND OBJECTS OF THE INVENTION

Accordingly, this invention has as its objective the provision of a new and improved gutter system for transporting water away from a premises associated with the gutter system.

It is yet a further object of this invention to provide a device of the character described above which is relatively easy to install, formed from components capable of enjoying the economies of mass production, and is extremely durable in construction, the configuration of which minimizes the tendency of ice formed on the roof to dissociate the gutter from its associated premises.

It is yet another object of this invention to provide a device of the character described above which requires substantially no maintenance.

It is yet another object of this invention to provide a device as characterized above which provides an improved through-flow of a liquid, such as water.

These and other objects will be made manifest when considering the following detailed specification when taken in conjunction with the appended drawing figures wherein there has been provided an improved gutter system including a trough having an inclined bottom wall, the trough of substantially closed configuration with the exception of a slit disposed along the longitudinal extent of a top portion thereof, the slit adapted to receive therewithin a comb member depending from and in one embodiment formed integrally with the outermost edge of a roof to cause water to migrate, by capillary attraction, into the trough system for rapid removal to a situ remote from the premises while precluding the migration of debris within the trough.

DESCRIPTION OF THE DRAWING FIGURES

DESCRIPTION OF THE PREFERRED EMBODIMENT

Figure 1:
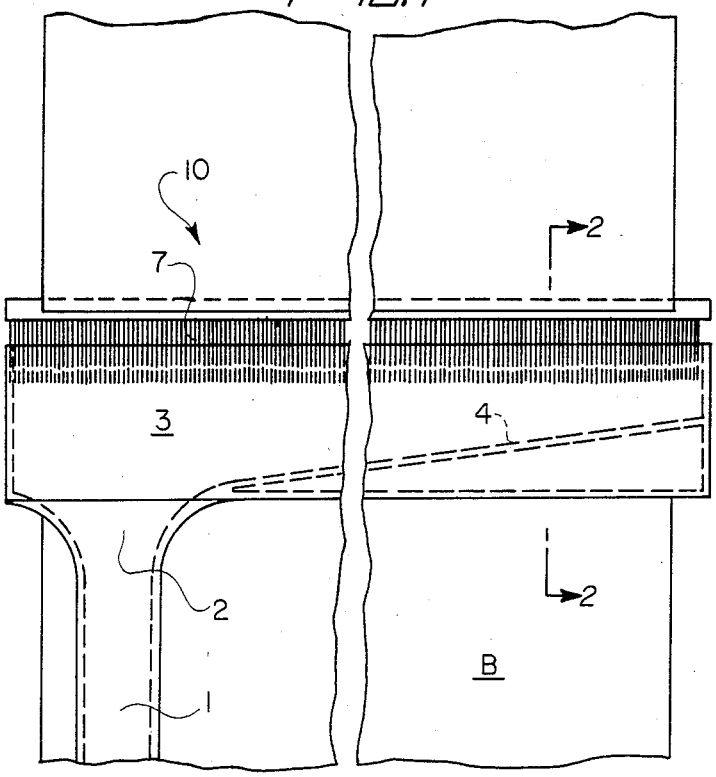
FIG. 1 is a front view of the apparatus according to the present invention.

Referring to the drawings now wherein like reference numerals refer to like parts throughout the various drawing figures, reference numeral 10 is directed to the gutter system according to the present invention.

Figure 2:
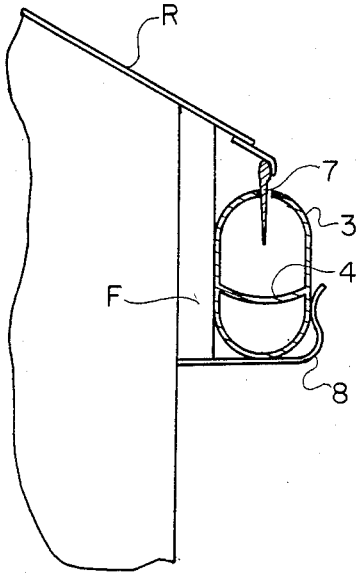
FIG. 2 is a side view thereof.
Figure 3:
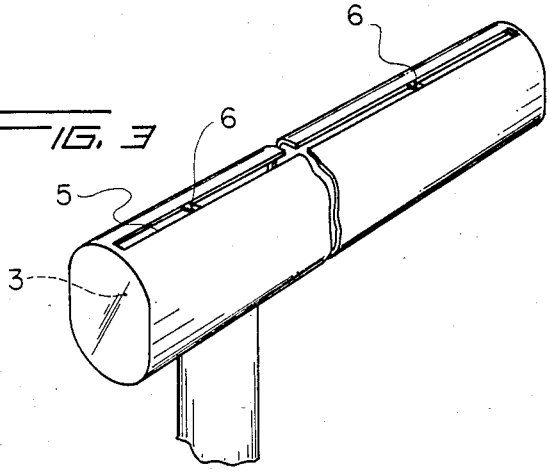
FIG. 3 is a perspective view of the trough removed from its environment.

More particularly, the gutter system 10 includes a downspout 1 suitably fastened to a side of a building B, the topmost portion of the downspout including a flared portion 2 allowing communication of the downspout 1 with a conduit 3. The conduit 3 includes a bottom wall, top wall and enclosing side walls with end walls formed integrally therewith so as to define an interior which is substantially impervious to liquid from without. In cross-section, the conduit may be of any suitable configuration, square, rectangular, oval, circular or the like, but in a preferred form it is ovaloid so that the top and bottom walls have curves for the following reasons. The bottom wall's curvature can nest within a resilient mounting bracket 8 as shown in FIG. 2 for ease in assembly, and the curved top wall discourages the provision of a purchase area which ice can use to detrimental advantage in removing the gutter from its fascia F depending from the roof R of FIG. 2.

In a preferred form of the invention, the interior of the conduit is provided with an internally disposed sloped bottom wall 4 which cants downwardly toward the flared portion 2 of the downspout 1 to increase the velocity of the fluid flow as it migrates from one end of the gutter remote from the downspout thereto.

A longitudinally extending slit 5 is provided on a topmost extremity of the conduit, and if the conduit is to be formed from a synthetic or plastic material which may have an internal resiliency, a plurality of spacers 6 are disposed within the slit, to make uniform the width of the slit. Disposed within the slit a continuous array of teeth somewhat similar to that found on a comb is provided, defined by a comb bar or member 11 allowing a plurality of downwardly depending comb teeth 7 all of uniform dimension to extend within the slit 5 of the conduit 3. The teeth have an upper portion of substantially rectangular cross-section which taper to points within the conduit itself. The comb bar 11 and the comb teeth 7 may all have textured surfaces to increase the capillary attraction of liquid impinging thereon. The manner in which the comb bar is to be attached to the roof will now be defined, but it is to be noted that the mounting bracket 8 can fasten to a bottom edge of the fascia and includes a laterally outwardly extending section, and an upwardly and inwardly arcuately oriented upper leg to resiliently attach the conduit in registry between the fascia underlying the roof.

Figure 4:
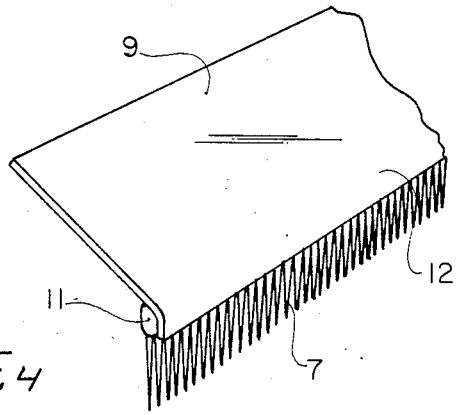
FIG. 4 shows one means for forming the comb according to the invention.
Figure 5:
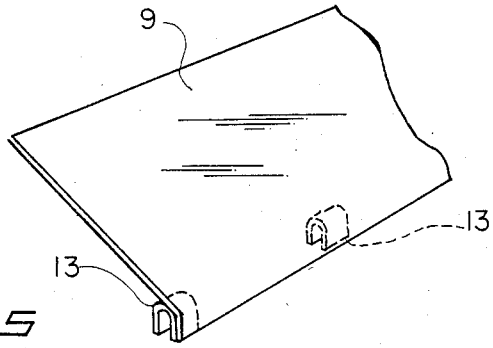
FIG. 5 shows a second way of forming the comb according to the invention.
Figure 6:
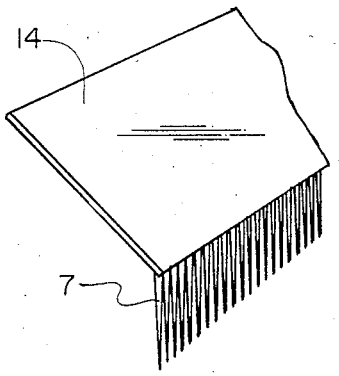
FIG. 6 shows a third way of forming the comb according to the invention.

FIGS. 4 through 6 teach the use of various intrumentalities for affixing the comb bar 11 adjacent the roof. For example, in FIG. 4 a comb support plate 9 which may be textured includes a textured downwardly depending lip 12 to which the comb bar 11 is attached along the inner and under faces of the lip and plate respectively. FIG. 5 provides a plurality of downwardly depending U-shaped clips which frictionally receive the comb bar 11 therewithin, the periodically disposed clips have sufficient spring tension to secure the comb bar 11 thereto. As shown, the clips depend from a bottom face of the support plate 9, and the clips may be of sufficient length and be of continuous construction so as to define a channel for reception of the comb bar therewithin. FIG. 6 features the use of having a shingle 14 provided with integrally formed downwardly depending comb teeth 7 so that when the lowermost edge of the roof shingle is to be applied on the premises, the type of shingles can be used directly to cause the conduit slit to overlie the teeth.

In use and operation, the comb teeth which depend from the roof in substantially a vertical plane cooperate with the shingle, comb support plate, lip 12, etc. to take advantage of the capillary at traction of water or other liquid and allow the liquid to migrate down the comb's teeth and through the slit to be deposited within the conduit.

With each embodiment, and as shown in the enclosed drawings particularly FIG. 4 thereof, the comb member 11 includes a planar first portion 9 secured to the roof and substantially following the shape of the roof as shown in FIG. 2. The comb member further has a second portion 7 formed integrally with (or otherwise carried by) the first portion and bent downwardly therefrom at an oblique angle. This second portion of the comb member is arranged in a substantially vertical plane (as shown more clearly in FIG. 2) and is provided with a plurality of comb teeth formed therein. These teeth extend through the longitudinal slot with a frictional engagement therebetween and into the conduit (as shown more clearly in FIG. 2) and such that the slot straddles the teeth. With this arrangement, the debris will wash off the roof and are precluded from entering into the conduit, and the water will flow by capillary action via the comb teeth and into the conduit.

Moreover, it should be evident that with the embodiment particularly shown in FIG. 2, accumulated ice migrating from the roof by overcoming the associated friction between the roof and the ice will not tend to engage the gutter since there is no purchase area on the gutter conduit and therefore not damage the gutter system. Moreover, it should be apparent that dirt, dust, twigs and deciduous matter will not be encouraged to migrate down the combs but rather will fall past the top wall of the conduit so that there has been provided a gutter system adapted to receive water only therewithin defining a substantially maintenance free structure.

Moreover, having thus described the invention it should be apparent that numerous structural modifications are contemplated as being part of the invention as set forth hereinabove and as defined hereinbelow by the claims.

What is claimed is:

1. A gutter system comprising in combination a downspout communicating with a substantially closed conduit disposed below the eaves of a sloped roof, the conduit having an upper portion provided with a longitudinal slit formed therein along the length of the conduit, the slit having respective edges, a comb member having a planar first portion secured to the roof and substantially following the slope of the roof, the comb member further having a second portion carried by the first portion and bent downwardly therefom, the second portion of the comb member being arranged in a substantially vertical plane and having a plurality of comb teeth formed therein, the teeth extending through the longitudinal slit and into the conduit, and the teeth being in substantial frictional engagement with the edges of the slit, whereby the debris will wash off the roof and the water will be carried by capillary action by the comb teeth into the conduit, and whereby debris will be precluded from entering into the conduit.

2. The device of claim 1 including a plurality of removeable spacers periodically spaced along said slot to render uniform said slit.

3. The device of claim 2 wherein said conduit is provided with a further bottom wall internally and sloped towards the downspout.

4. the device of claim 3 wherein mounting brackets are provided which extend from a roof fascia below said conduit and up to one side wall thereof for retaining the conduit adjacent the roof.

5. The device of claim 4 wherein said comb teeth are supported by a comb bar, said teeth equally spaced and having constant section along their length tapering to a point.

6. The device of claim 5 wherein said comb bar is attached to an associated comb support plate.

7. The device of claim 6 wherein said comb bar is attached to said support plate by means of periodic clips depending from a bottom face of said plate.

8. The device of claim 6 wherein said support plate includes a depending lip to which said comb bar fastens.

9. The device of claim 6 wherein said support plate is a shingle and has a textured surface.

10. A gutter system for the migration of water comprising in combination a plurality of vertically downwardly depending spaced teeth extending from an edge of a roof at an oblique angle thereto, said teeth having a substantially uniform dimension and further having substantially constant cross-section, substantially enclosed conduit means surrounding a substantially vertically depending portion of said teeth and including a longitudinal slit having edge means which substantially straddles and encompasses said teeth with substantial frictional engagement therebetween, whereby spaces between adjacent teeth provide a capillary means of egress for said water from said roof into said conduit, and whereby the debris washes off the roof and is precluded from entering into the conduit.

11. The device of claim 10 wherein said conduit means includes a top wall, side walls and a bottom wall, said bottom wall communicating with a downspout.

12. The device of claim 11 wherein said teeth are formed with a supportive comb bar.

13. The device of claim 12 wherein said comb bar attaches to the leading edge of the roof through a support plate.

14. The device of claim 13 wherein said support plate is textured.

15. The device of claim 14 wherein said support plate attaches to said comb bar by a depending lip attached to one side of said comb bar.

16. The device of claim 14 wherein said support plate attaches to said comb bar by means of clips spaced along the length thereof.

17. The device of claim 14 wherein said comb bar is supported by a shingle.

18. The device of claim 17 including bracket means for securing said conduit against a fascia of the roof.

19. The device of claim 18 including an internally sloped bottom wall within said conduit extending and declinated towards the downspout.

* * * * *